US009224329B2

(12) United States Patent
Kim et al.

(10) Patent No.: US 9,224,329 B2
(45) Date of Patent: Dec. 29, 2015

(54) ORGANIC LIGHT EMITTING DIODE DISPLAY DEVICE AND METHOD FOR DRIVING THE SAME

(71) Applicant: LG Display Co., Ltd., Seoul (KR)

(72) Inventors: Binn Kim, Seoul (KR); Joonsoo Han, Siheung-si (KR)

(73) Assignee: LG DISPLAY CO., LTD., Seoul (KR)

( * ) Notice: Subject to any disclaimer, the term of this patent is extended or adjusted under 35 U.S.C. 154(b) by 206 days.

(21) Appl. No.: 13/665,061

(22) Filed: Oct. 31, 2012

(65) Prior Publication Data

US 2013/0088417 A1 Apr. 11, 2013

(30) Foreign Application Priority Data

Aug. 1, 2012 (KR) ..... 10-2012-0084517

(51) Int. Cl.
*G09G 3/30* (2006.01)
*G09G 3/32* (2006.01)

(52) U.S. Cl.
CPC ..... *G09G 3/3225* (2013.01); *G09G 3/3233* (2013.01); *G09G 3/3291* (2013.01); *G09G 2300/0819* (2013.01); *G09G 2300/0852* (2013.01)

(58) Field of Classification Search
CPC ..... G09G 3/30
USPC ..... 345/76, 77–81; 257/40
See application file for complete search history.

(56) References Cited

U.S. PATENT DOCUMENTS

| | | | | |
|---|---|---|---|---|
| 2004/0145547 | A1 | 7/2004 | Oh | |
| 2005/0052366 | A1 | 3/2005 | Kim | |
| 2008/0224965 | A1* | 9/2008 | Kim | 345/76 |
| 2010/0123697 | A1* | 5/2010 | Goh et al. | 345/208 |
| 2011/0157135 | A1* | 6/2011 | Lee et al. | 345/211 |
| 2012/0038605 | A1* | 2/2012 | Han | 345/211 |

FOREIGN PATENT DOCUMENTS

| | | | |
|---|---|---|---|
| CN | 1517965 | A | 8/2004 |
| CN | 1595484 | A | 3/2005 |
| CN | 101192374 | A | 6/2008 |
| KR | 20040008684 | A | 1/2004 |
| KR | 1020050049686 | A | 5/2005 |

OTHER PUBLICATIONS

Office Action issued in Chinese Patent Application No. 201210499296.7, mailed Mar. 19, 2015, 16 pages.

* cited by examiner

*Primary Examiner* — Pegeman Karimi
(74) *Attorney, Agent, or Firm* — Brinks Gilson & Lione

(57) ABSTRACT

An OLED display device is provided. The OLED display device includes a first transistor connected to a data line and a first node; a second transistor connected to the first node and a second node; a third transistor connected to a reference voltage terminal and a third node; a fourth transistor connected to an initialization voltage terminal and the second node; a fifth transistor connected to the reference voltage terminal and the second node; a driving transistor; and an OLED connected to a low-level power supply voltage terminal and the second node. The driving transistor has a source connected to the second node, a gate connected to the third node, and a drain connected to a high-level power supply voltage terminal.

20 Claims, 10 Drawing Sheets

ORGANIC LIGHT EMITTING DIODE DISPLAY DEVICE AND METHOD FOR DRIVING THE SAME

This application claims the priority benefit of the Korean Patent Application No. 10-2012-0084517 filed on Aug. 1, 2012, which is hereby incorporated by reference as if fully set forth herein.

BACKGROUND

1. Field of the Invention

The present disclosure relates to a display device, and more particularly, to an organic light emitting diode (OLED) display device and a driving method thereof.

2. Discussion of the Related Art

With the advancement of information-oriented society, various requirements for display field are increasing, and thus, research is being done on various flat panel display devices that are thin and light, and have low power consumption. For example, the flat panel display devices are categorized into liquid crystal display (LCD) devices, plasma display panel (PDP) devices, OLED display devices, etc.

Especially, OLED display devices that are being actively studied recently apply data voltage (Vdata) having various levels to respective pixels to display different grayscale levels, thereby realizing an image.

To drive the pixels, various control signals for controlling a plurality of transistors such as switching transistors, driving transistors, and emission control transistors are necessary. The plurality of control signals, for example, include a scan signal (Scan), a control signal (Control), and an emission control signal (Em).

Particularly, an emission control transistor that is driven by the emission control signal needs to hold a turn-on state for a relatively long time, and thus, the emission control transistor is quickly deteriorated, causing the degradation of image quality.

Moreover, when the threshold voltage of a driving transistor is a negative voltage, it is unable to compensate for the negative threshold voltage, and thus, the level of a current flowing in an OLED is largely changed according to the deviation of the negative threshold voltage and the deviation of a low-level power supply voltage due to IR drop, causing the degradation of image quality.

BRIEF SUMMARY

In an aspect of the present disclosure, there is provided an OLED display device including: a first transistor connected to a data line and a first node, and transferring a data voltage, supplied through the data line, to the first node; a second transistor connected to the first node and a second node; a third transistor connected to a reference voltage terminal and a third node, and transferring a reference voltage, supplied from the reference voltage terminal, to the third node; a fourth transistor connected to an initialization voltage terminal and the second node, and transferring an initialization voltage, supplied from the initialization voltage terminal, to the second node; a fifth transistor connected to the reference voltage terminal and the second node; a driving transistor having a source connected to the second node, a gate connected to the third node, and a drain connected to a high-level power supply voltage terminal; and an OLED connected to a low-level power supply voltage terminal and the second node.

In another aspect of the present disclosure, there is provided a method of driving an OLED display device. In the method, an OLED display includes the aforementioned first to fifth transistors, a driving transistor, and an OLED is provided. While the second to fourth transistors are turned on, an initialization voltage is applied to a first and second nodes and a reference voltage is applied to a third node. While the second and third transistors are turned on, a threshold voltage is applied to the driving transistor. While the first and fifth transistors are turned on, a data voltage is applied to the first node. The OLED emits light while the first to fifth transistors are turned off.

In another aspect of the present disclosure, there is provided an OLED display device including: a first transistor connected to a data line and a first node, and transferring a data voltage, supplied through the data line, to the first node; a second transistor connected to the first node and a second node; a third transistor connected to a reference voltage terminal and a third node, and transferring a reference voltage, supplied from the reference voltage terminal, to the third node; a fourth transistor connected to an initialization voltage terminal and the second node, and transferring an initialization voltage, supplied from the initialization voltage terminal, to the second node; a fifth transistor connected to the reference voltage terminal and the second node; a driving transistor having a source connected to the second node, a gate connected to the third node, and a drain connected to a high-level power supply voltage terminal; and an OLED connected to a low-level power supply voltage terminal and the second node. The current flowing in the OLED is determined by a voltage proportional to the data voltage.

It is to be understood that both the foregoing general description and the following detailed description of the present disclosure are exemplary and explanatory.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION OF THE DRAWINGS AND THE PRESENTLY PREFERRED EMBODIMENTS

The present disclosure is directed to provide an organic light emitting diode (OLED) display device and a driving method thereof that substantially obviate one or more problems due to limitations and disadvantages of the related art.

An aspect of the present disclosure is directed to provide an OLED display device and a driving method thereof that can prevent image quality from being degraded due to the deviation of a threshold voltage, the deviation of a low-level power supply voltage, and the deterioration of an emission control transistor.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

Reference will now be made in detail to the exemplary embodiments of the present disclosure, examples of which are illustrated in the accompanying drawings. Wherever possible, the same reference numbers will be used throughout the drawings to refer to the same or like parts.

Hereinafter, embodiments of the present disclosure will be described in detail with reference to the accompanying drawings.

Figure 1:
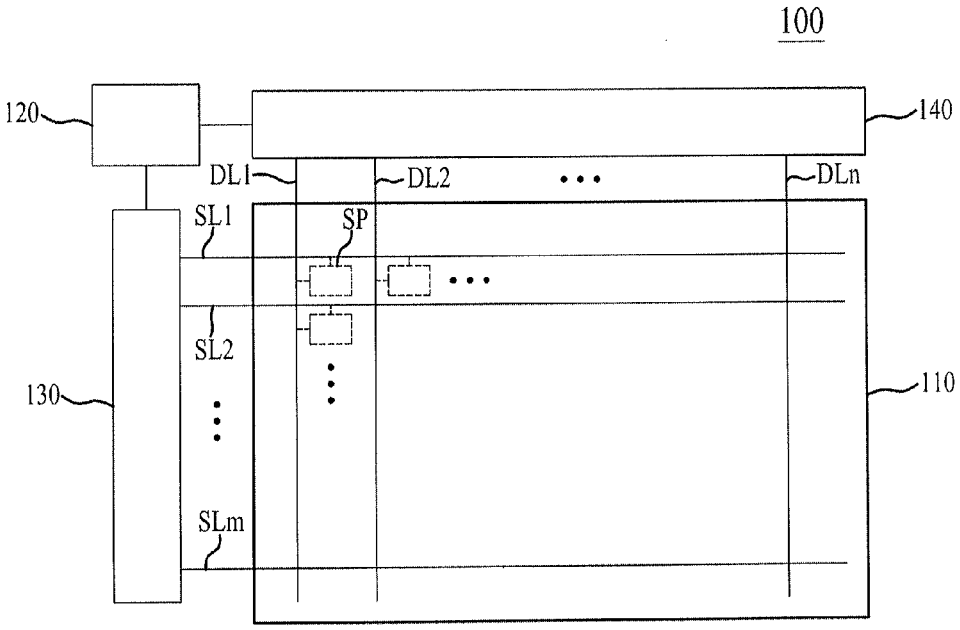
FIG. 1 is a diagram schematically illustrating a configuration of an OLED display device according to embodiments of the present disclosure.

FIG. 1 is a diagram schematically illustrating a configuration of an OLED display device according to embodiments of the present disclosure.

As illustrated in FIG. 1, an OLED display device 100 according to embodiments of the present disclosure includes a panel 110, a timing controller 120, a scan driver 130, and a data driver 140.

The panel 110 includes a plurality of sub-pixels SP that are arranged in a matrix type. The sub-pixels SP included in the panel 110 emit light according to respective scan signals that are supplied through a plurality of scan lines SL1 to SLm from the scan driver 120 and respective data signals that are supplied through a plurality of data lines DL1 to DLn from the data driver 130. To this end, one sub-pixel includes an OLED, and a plurality of transistors and capacitors for driving the OLED. The detailed configuration of each of the sub-pixels SP will be described in detail with reference to FIG. 2.

The timing controller 120 receives a vertical sync signal Vsync, a horizontal sync signal Hsync, a data enable signal DE, a clock signal CLK, and video signals from the outside. Also, the timing controller 120 aligns external input video signals to digital image data RGB in units of a frame.

For example, the timing controller 120 controls the operational timing of each of the scan driver 130 and the data driver 140 using a timing signal that includes the vertical sync signal Vsync, the horizontal sync signal Hsync, the data enable signal DE, and the clock signal CLK. To this end, the timing controller 120 generates a gate control signal GCS for controlling the operational timing of the scan driver 130 and a data control signal DCS for controlling the operational timing of the data driver 140.

The scan driver 120 generates a scan signal "Scan" that enables the operations of transistors included in each of the sub-pixels SP included in the panel 110, according to the gate control signal GCS supplied from the timing controller 120, and supplies the scan signal "Scan" to the panel 110 through the scan lines SL.

The data driver 130 generates data signals with the digital image data RGB and the data control signal DCS that are supplied from the timing controller 120, and supplies the generated data signals to the panel 110 through the respective data lines DL.

Hereinafter, the detailed configuration of each sub-pixel will be described in detail with reference to FIGS. 1 and 2.

Figure 2:
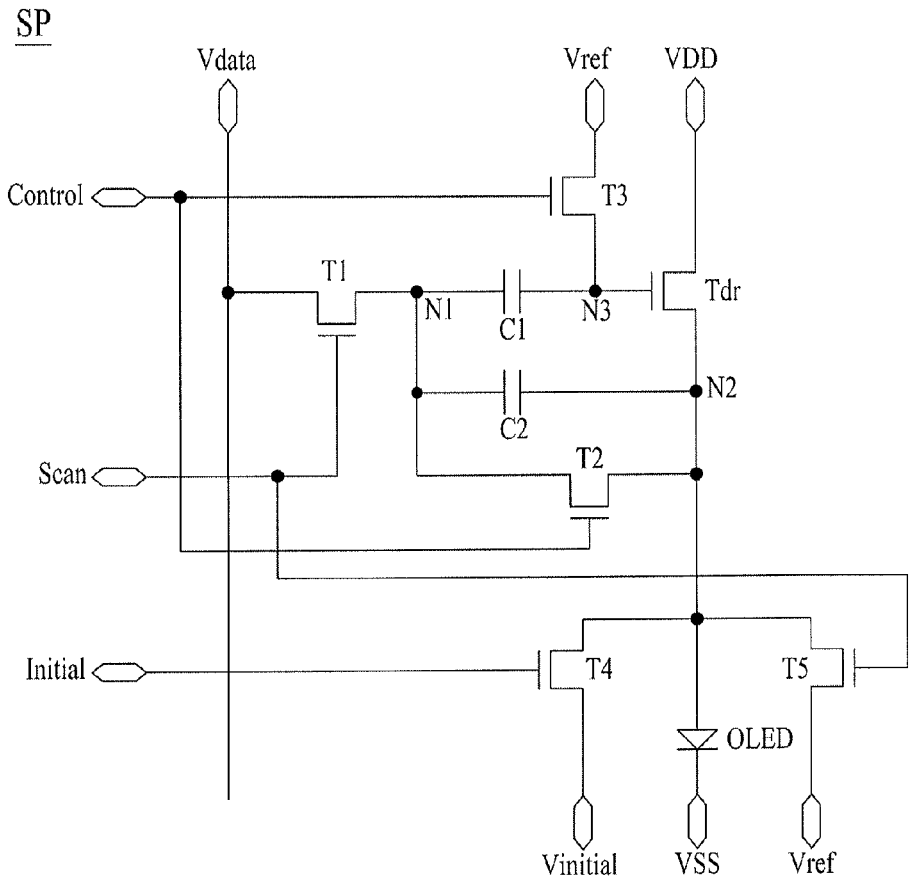
FIG. 2 is a diagram schematically illustrating an equivalent circuit of a sub-pixel of FIG. 1.

FIG. 2 is a diagram schematically illustrating an equivalent circuit of a sub-pixel of FIG. 1.

As illustrated in FIG. 2, each sub-pixel SP may include first to fifth transistors T1 to T5, a driving transistor Tdr, first and second capacitors C1 and C2, and an OLED.

The first to fifth transistors T1 to T5 and the driving transistor Tdr, as illustrated in FIG. 2, are NMOS transistors, but are not limited thereto. As another example, a PMOS transistor may be applied thereto, in which case a voltage for turning on the PMOS transistor has a polarity opposite to that of a voltage for turning on the NMOS transistor.

A data voltage "Vdata" is applied as a data signal to a drain of the first transistor T1, and the scan signal "Scan" is applied to a gate of the first transistor T1. Also, a source of the first transistor T1 is connected to a first node N1 corresponding to one end of each of the first and second capacitors C1 and C2.

Therefore, the operation of the first transistor T1 may be controlled according to the scan signal "Scan" supplied through a corresponding scan line SL. For example, the first transistor T1 is turned on according to the scan signal "Scan," and supplies a data voltage "Vdata" to the first node N1.

Subsequently, a drain of the second transistor T2 is connected to the first node N1, a gate of the second transistor T2 receives a control signal "Control," and a source of the second transistor T2 is connected to a second node N2 corresponding to the other end of the second capacitor C2 and a source of the driving transistor Tdr.

Therefore, the operation of the second transistor T2 may be controlled according to the control signal "Control" supplied through a control line (not shown). For example, the second transistor T2 is turned on according to the control signal "Control," and initializes the voltage of the first node N1 to that of the second node N2.

Subsequently, a reference voltage "Vref" is applied to a source of the third transistor T3, and the control signal "Control" is applied to a gate of the third transistor T3. Also, a drain of the third transistor T3 is connected to a third node N3 corresponding to the other end of the first capacitor C1 and a gate of the driving transistor Tdr.

Therefore, the operation of the third transistor T3 may be controlled according to the control signal "Control" supplied through the control line (not shown). For example, the third transistor T3 is turned on according to the control signal "Control," and initializes the voltage of the third node N3 to the reference voltage "Vref." Here, for example, the reference voltage "Vref" may be −5 V to 5 V.

Subsequently, a initialization voltage "Vinitial" is applied to a source of the fourth transistor T4, and an initialization signal "Initial" is applied to a gate of the fourth transistor T4. Also, a drain of the fourth transistor T4 is connected to an anode of the OLED.

Therefore, the operation of the fourth transistor T4 may be controlled according to the initialization signal "Initial" supplied through an initialization line (not shown). For example, the fourth transistor T4 is turned on according to the initialization signal "Initial," and initializes the voltage of the second node N2 to the initial voltage "Vinitial." Here, the initialization voltage "Vinitial" is lower than the threshold voltage of the OLED, and for example, may be −10 V to 0 V.

Therefore, a current is not applied to the OLED, and thus, the OLED does not emit light.

Subsequently, the reference voltage "Vref" is applied to a source of the fifth transistor T5, and the scan signal "Scan" is applied to a gate of the fifth transistor T5. Also, a drain of the fifth is connected to the second node N2. In another embodiment of the present disclosure, the initialization voltage "Vinitial" or a low-level power supply voltage "VSS" other than the reference voltage "Vref" may be applied to the source of the fifth transistor T5.

Therefore, the operation of the fifth transistor T5 may be controlled according to the scan signal "Scan" supplied through a corresponding scan line SL. For example, the fifth transistor T5 is turned on according to the scan signal "Scan," and supplies a voltage "Vref+a" higher than or equal to the reference voltage "Vref" to the second node N2. This is because the driving transistor Tdr and the fifth transistor T5 are simultaneously turned on, and thus, a current path is formed between a high-level power supply voltage "VDD" terminal and a reference voltage "Vref" terminal. Here, the voltage "a" is a voltage with consideration of the drop of a voltage due to the current path, and may be changed according to the gate voltage of the driving transistor Tdr.

The first capacitor C1 may be a sensing capacitor that is connected between the first node N1 and a third node N3 and used to sense the threshold voltage "Vth" of the driving transistor Tdr.

The second capacitor C2 may be a storage capacitor that is connected between the first node N1 and the second node N2, and holds a data voltage during one frame, thereby maintaining a constant current flowing in the OLED and a constant gray scale realized by the OLED.

The high-level power supply voltage "VDD" is applied to the drain of the driving transistor Tdr, the gate of the driving transistor Tdr is connected to the third node N3, and the source of the driving transistor Tdr is connected to the second node N2 that corresponds to the anode of the OLED and the drain of each of the fourth and fifth transistors T4 and T5. For example, the high-level power supply voltage "VDD" may be 10 V to 20 V.

For example, the driving transistor Tdr may adjust the amount of a current flowing in the OLED according to a voltage applied to the third node Nd3 corresponding to the gate of the driving transistor Tdr. The voltage applied to the third node N3 is higher by the threshold voltage "Vth" of the driving transistor T5 than the data voltage "Vdata." Therefore, the amount of the current flowing in the OLED is proportional to the level of the data voltage "Vdata." Accordingly, the OLED display device according to embodiments of the present disclosure applies data voltages "Vdata" having various levels to the respective sub-pixels SP to realize different gray scales, thereby displaying an image.

In this way, the OLED display device according to embodiments of the present disclosure uses a source follower structure in which the source of the driving transistor Tdr does not receive a fixed voltage and is connected to a load. Therefore, even when the threshold voltage of the driving transistor Tdr has a negative polarity, the OLED display device according to embodiments of the present disclosure is capable of sensing the threshold voltage, and thus can compensate for the deviation of the threshold voltage irrespective of the polarity of the threshold voltage.

In an embodiment, the OLED display device compensates for the change (which is caused by the deviation of a positive or negative threshold voltage) in a current that flows in an OLED and thus maintains a constant current based on a data voltage "Vdata" irrespective of the deviation of the threshold voltage.

The anode of the OLED is connected to the second node N2, and the low-level power supply voltage "VSS" is applied to a cathode of the OLED. Here, for example, the low-level power supply voltage "VSS" may be 0 V to 5 V.

Hereinafter, the operation of each sub-pixel included in the OLED display device according to embodiments of the present disclosure will be described in detail with reference to FIGS. 3 and 4A to 4D.

Figure 3:
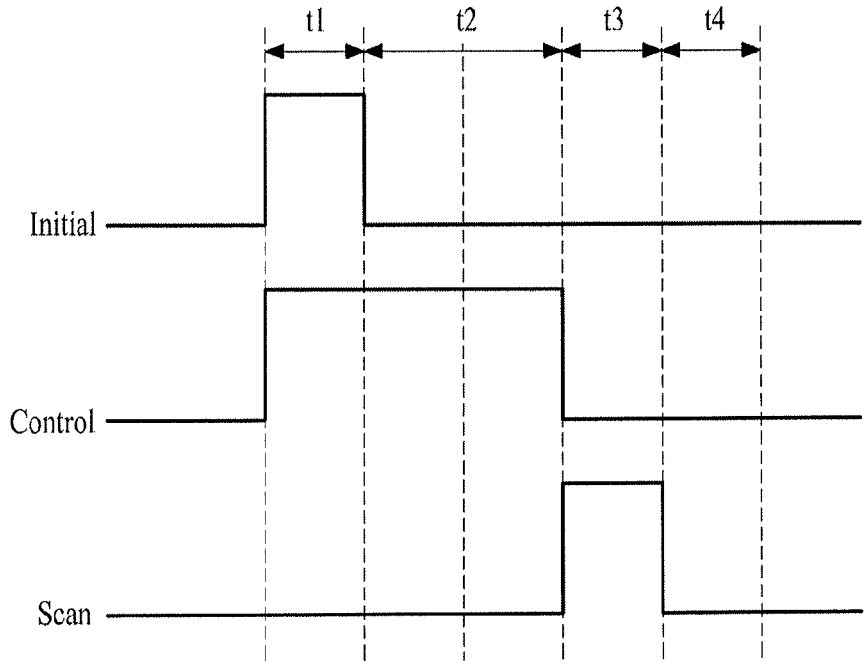
FIG. 3 is a timing chart according to a first embodiment of each of a plurality of control signals supplied to the equivalent circuit of FIG. 2.

FIG. 3 is a timing chart according to a first embodiment of each of a plurality of control signals supplied to the equivalent circuit of FIG. 2. FIGS. 4A to 4D are diagrams for describing a driving method of an OLED display device according to embodiments of the present disclosure.

As illustrated in FIG. 3, during an initialization time period t1, a high-level initialization signal "Initial" and a high-level signal "Control" are applied to a sub-pixel, and a low-level scan signal "Scan" is applied to the sub-pixel.

Figure 4A:
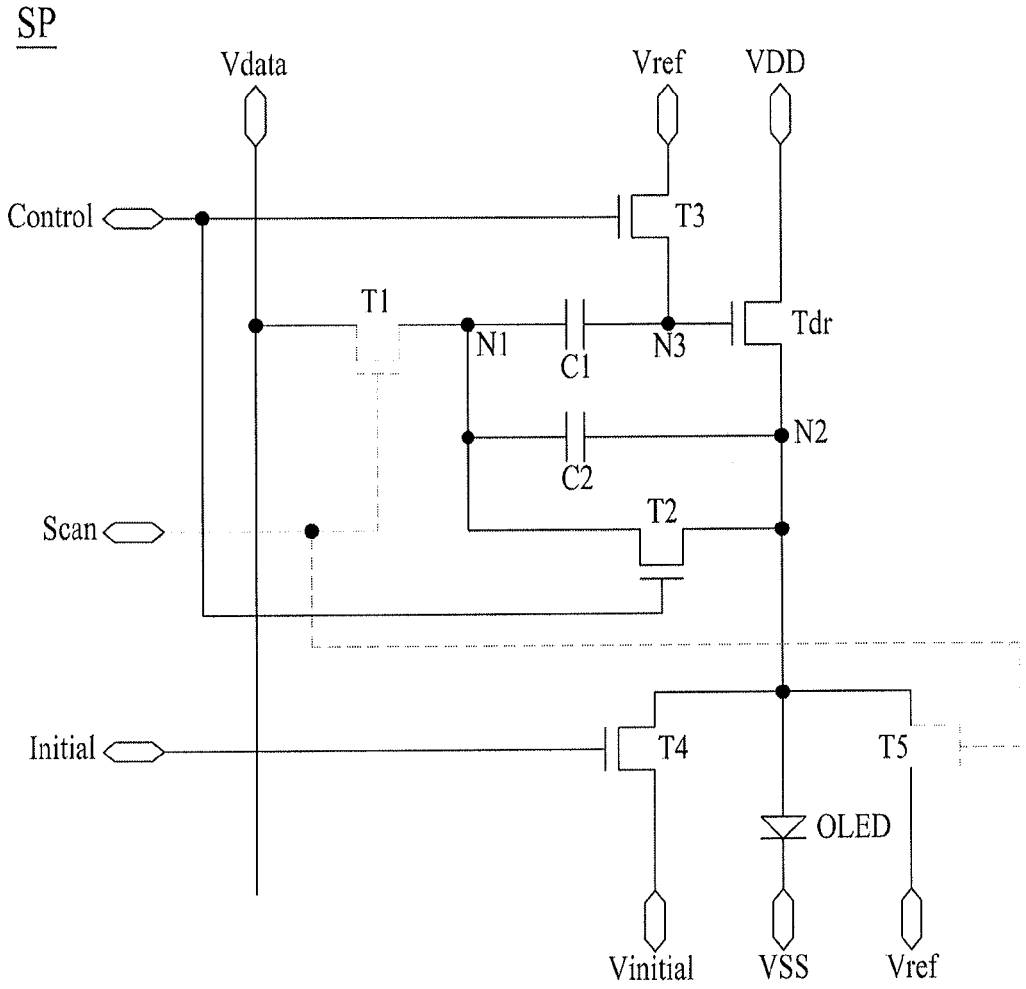
FIGS. 4A to 4D are diagrams for illustrating a driving method of an OLED display device according to embodiments of the present disclosure during different time periods illustrated in FIG. 3.

Therefore, as illustrated in FIG. 4A, the fourth transistor T4 is turned on by the high-level initialization signal "Initial," and the second and third transistors T2 and T3 are turned on by the high-level control signal "Control." Also, the first and fifth transistors T1 and T2 are turned off by the low-level scan signal "Scan."

As a result, during the initialization time period t1, the third node N3 is initialized to the reference voltage "Vref," and the first and second nodes N1 and N2 are initialized to the initialization voltage "Vinitial."

For example, during the initialization time period t1, as the third transistor T3 is turned on, a current path is formed between the third node N3 and a reference voltage "Vref" terminal, and thus, the third node N3 is initialized to the reference voltage "Vref." Also, as the fourth transistor T4 is turned on, a current path is formed between the second node N2 and an initialization voltage "Vinitial" terminal, and thus, the second node N2 is initialized to the initialization voltage "Vinitial." Furthermore, as the second transistor T2 is turned on, a current path is also formed between the second node N2 and the first node N1, and thus, the first node N1 is initialized to the initialization voltage "Vinitial" corresponding to the voltage of the second node N2.

Here, the initialization voltage "Vinitial" may be set as a voltage lower than the sum of the threshold voltage "Vth_oled" and cathode voltage "VSS" of the OLED (Vinitial<Vth_oled+VSS). Also, the threshold voltage "Vth_oled" of the OLED is a voltage with which the OLED starts to emit light, and when a voltage lower than the threshold voltage "Vth_oled" is applied to both ends of the OLED, the OLED does not emit light.

Therefore, during the initialization time period t1, by initializing the second node N2 to the initialization voltage "Vinitial," the OLED is turned off.

Referring again to FIG. 3, during a threshold voltage sensing time period t2, a high-level control signal "Control" is applied to a sub-pixel, and a low-level initialization signal "Initial" and a low-level scan signal "Scan" are applied to the sub-pixel.

Figure 4B:
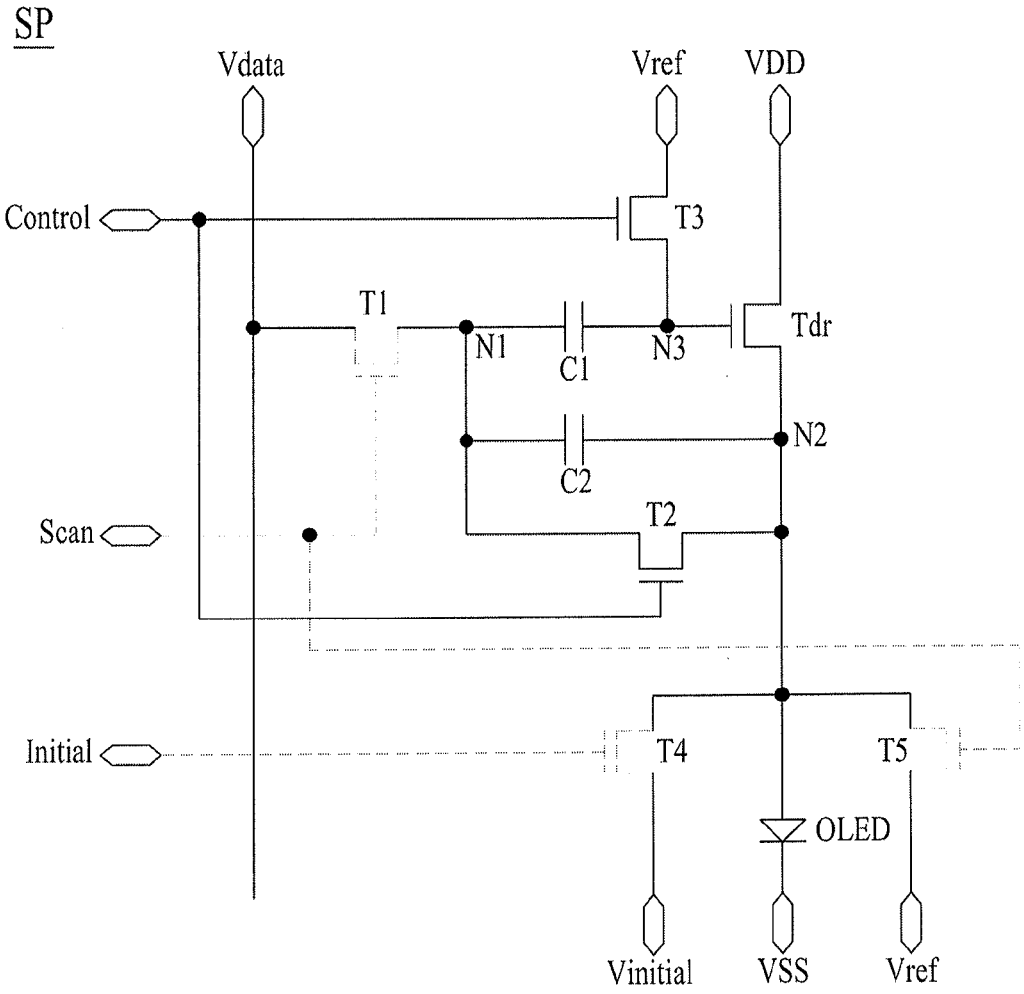

Therefore, as illustrated in FIG. 4B, the second and third transistors T2 and T3 are turned on by the high-level control signal "Control," the first and fifth transistors T1 and T5 are turned off by the low-level scan signal "Scan," and the fourth transistor T4 is turned off by the low-level initialization signal "Initial."

As a result, during the threshold voltage sensing time period t2, the third node N3 holds the reference voltage "Vref," and a voltage "Vref−Vth" equal to a difference between the reference voltage "Vref" and the threshold voltage "Vth" of the driving transistor Tdr is applied to the first and second nodes N1 and N2.

For example, during the threshold voltage sensing time period t2, the third transistor T3 maintains a turn-on state, and thus, the reference voltage "Vref" is continuously applied to the third node N3. Also, the threshold voltage "Vth" of the driving transistor Tdr is applied to a position between the second node N2 and the third node N3, and thus, a voltage "Vref−Vth" is applied to the second node N2, in which case the second transistor T2 maintains a turn-on state and thus the voltage "Vref−Vth" may be applied to the first node N1. As a result, the first capacitor C1 stores the threshold voltage "Vth" of the driving transistor Tdr.

Here, the voltage "Vref−Vth" of each of the first and second nodes N1 and N2 may be set as a voltage lower than the sum of the threshold voltage "Vth_oled" and cathode voltage "VSS" of the OLED (Vref−Vth<Vth_oled+VSS).

Therefore, during the threshold voltage sensing time period t2, the second node N2 holds the voltage "Vref−Vth," and thus, the OLED maintains a turn-off state.

The threshold voltage sensing time period t2 may be adjusted by adjusting the pulse width of the control signal "Control" of FIG. 3. Therefore, by broadening the pulse width of the control signal "Control," the deviation of a threshold voltage can be more accurately compensated for.

Referring again to FIG. 3, during a data application time period t3, a high-level scan signal "Scan" is applied to a sub-pixel, and a low-level initialization signal "Initial" and a low-level control signal "Control" are applied to the sub-pixel.

Figure 4C:
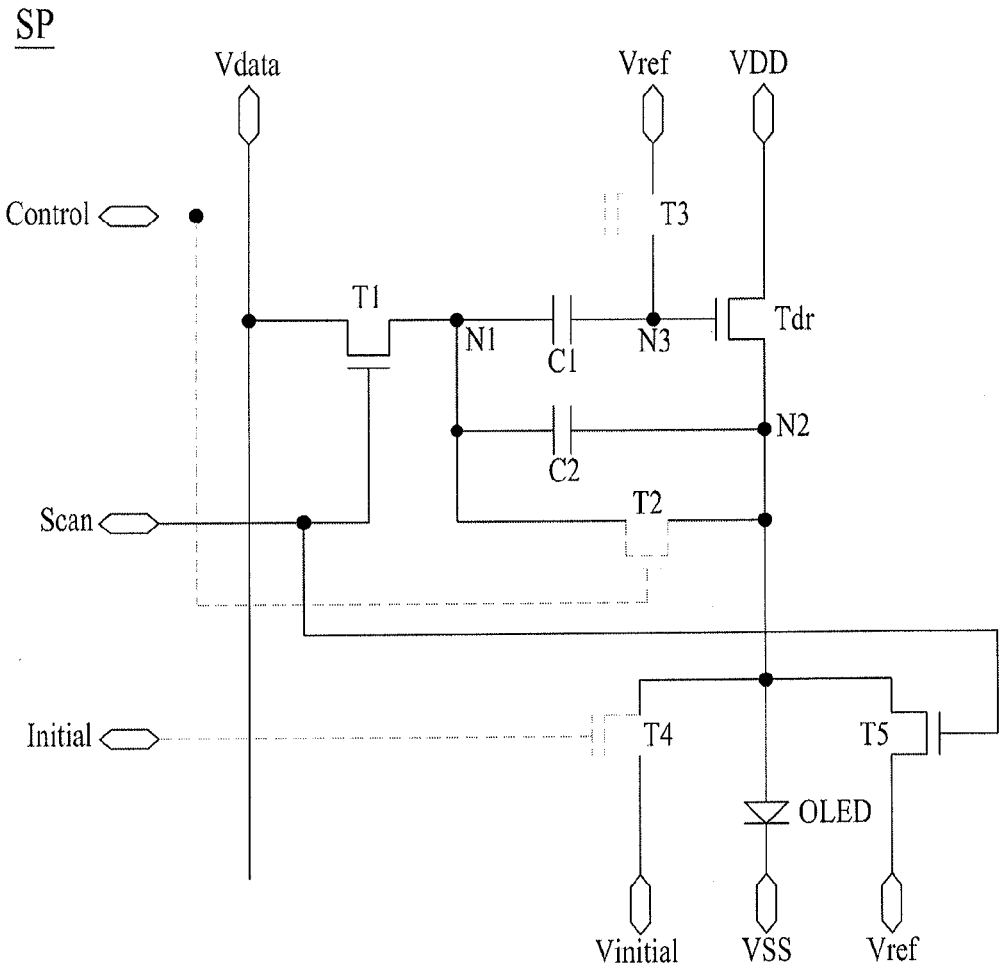

Therefore, as illustrated in FIG. 4C, the first and fifth transistors T1 and T5 are turned on by the high-level scan signal "Scan," and the second and third transistors T2 and T3 are turned off by the low-level control signal "Control," and the fourth transistor T4 is turned off by the low-level initialization signal "Initial."

As a result, during the data application time period t3, a data voltage "Vdata" is applied to the first node N1, a voltage "Vdata+Vth" equal to the sum of the threshold voltage "Vth" of the driving transistor Tdr and the data voltage "Vdata" (which is the voltage of the first node N1) is applied to the third node N3. Also, a voltage "Vref+a" higher than or equal to the reference voltage "Vref" is applied to the second node N2.

For example, during the data application time period t3, as the first transistor T1 is turned on, a current path is formed between a data line and the first node N1, and thus, the data voltage "Vdata" is applied to the first node N1. Also, a voltage "Vdata+Vth" higher by the threshold voltage "Vth" than the data voltage "Vdata" is applied to the third node N3 by the first capacitor C1 that stores the threshold voltage "Vth" of the driving transistor Tdr. Also, as the fifth transistor T5 is turned on, a current path is formed between the high-level power supply voltage "VDD" terminal and the reference voltage "Vref" terminal. Thus, a voltage "Vref+a" is applied to the second node N2. Here, the voltage "a" is a voltage with consideration of the drop of a voltage due to the current path that is formed between the high-level power supply voltage "VDD" terminal and the reference voltage "Vref" terminal when the driving transistor Tdr and the fifth transistor Tdr is simultaneously turned on. The voltage "Vref+a" corresponding to the sum of the reference voltage "Vref" and the voltage "a" (which is generated by the drop of a voltage) is applied to the second node N2.

During the data application time period t3, the voltage "Vref+a" of the second node N2 is lower than a voltage "VSS+Vth_oled," and thus, the OLED maintains a turn-off state.

Referring again to FIG. 3, during an emission time period t4, a low-level initialization signal "Initial," a low-level control signal "Control," and a low-level scan signal "Scan" are applied to a sub-pixel.

Figure 4D:
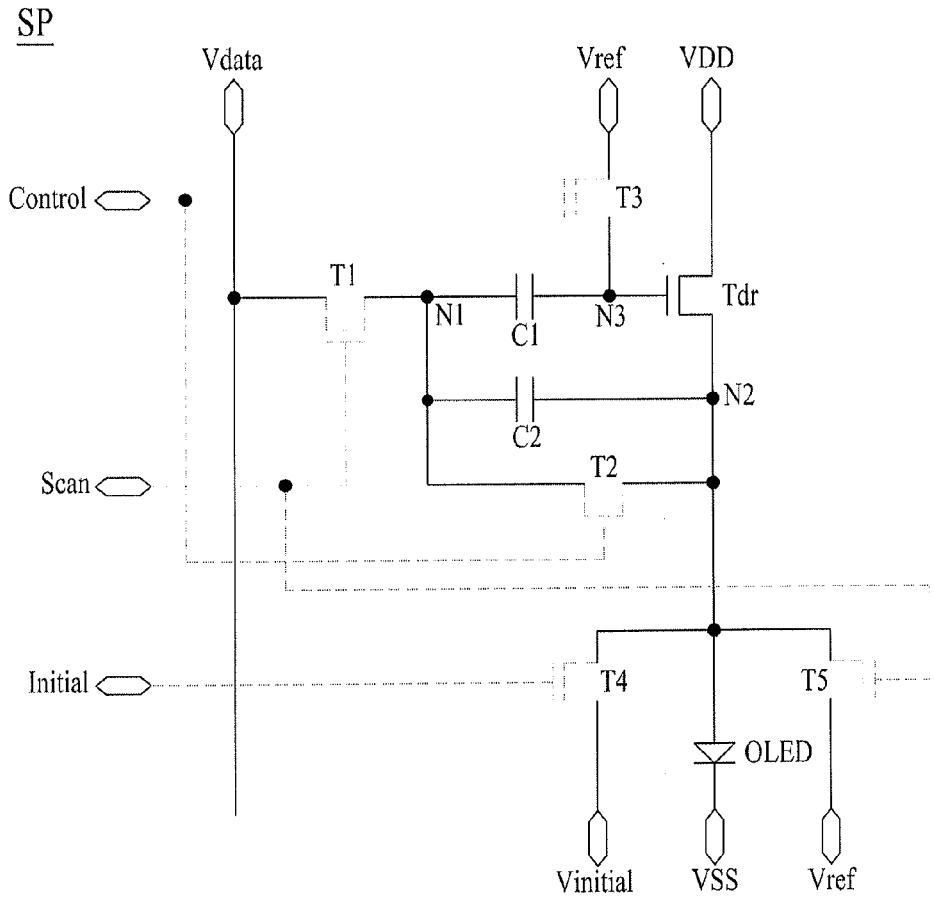

Therefore, as illustrated in FIG. 4D, the first to fifth transistors T1 to T5 are all turned off.

As a result, at a time at which the emission time period t4 is started, the first node N1 holds the data voltage "Vdata," the third node N3 holds the voltage "Vdata+Vth," and the second node N2 holds the voltage "Vref+a." Then, since all of the first to fifth transistors T1 to T5 have been turned off, the voltage of each of the nodes is changed, and thus, when the voltage of the second node N2 is higher than a voltage "VSS+Vth_oled," the OLED starts to emit light.

However, even though the voltage of each node is changed, a voltage difference "Vgs" between the gate and source of the driving transistor Tdr is not changed.

Therefore, a current "$I_{OLED}$" flowing in the OLED may be defined as expressed in the following Equation (1). Also, in order to simply express Equation (1), the data voltage "Vdata" is assumed as the sum of the reference voltage "Vref" and an arbitrary voltage "Va" (Vdata=Va+Vref). In other words, since the reference voltage "Vref" is constant, it can be seen that the arbitrary voltage "Va" is proportional to the data voltage "Vdata."

$$\begin{aligned} I_{OLED} &= K \times (Vgs - Vth)^2 \\ &= K \times (Vdata + Vth - Vref - a - Vth)^2 \\ &= K \times (Va + Vref - Vref - a)^2 \\ &= K \times (Va - a)^2 \end{aligned} \tag{1}$$

where K denotes a proportional constant that is determined by the structure and physical properties of the driving transistor Tdr, and may be determined with the mobility of the driving transistor Tdr and the ratio "W/L" of the channel width "W" and length "L" of the driving transistor Tdr. The threshold voltage "Vth" of the driving transistor Tdr does not always have a constant value, and the deviation of the threshold voltage "Vth" occurs according to the operational state of the driving transistor Tdr.

Referring to Equation (1), in the OLED display device according to embodiments of the present disclosure, the current "$I_{OLED}$" flowing in the OLED may be determined with the arbitrary voltage "Va" proportional to the data voltage. Thus, the current "$I_{OLED}$" is not affected by the threshold voltage "Vth" of the driving transistor Tdr, the reference voltage "Vref," or the low-level power supply voltage "VSS" during the emission time period t4.

Accordingly, by compensating for the deviation of the threshold voltage due to the operational state of the driving transistor and the deviation of the low-level power supply voltage due to IR drop, the OLED display device according to embodiments of the present disclosure maintains a constant current flowing in an OLED, thus preventing the degradation of image quality.

In FIG. 3, the operations of the first to fifth transistors have been described above as being controlled by the control signals such as the initialization signal "Initial," the control signal "Control," and the scan signal "Scan." However, in another embodiment of the present disclosure, the control signals may be scan signals that are outputted from the same driving driver.

Hereinafter, a plurality of control signals according to another embodiment of the present disclosure will be described with reference to FIG. 5.

Figure 5:
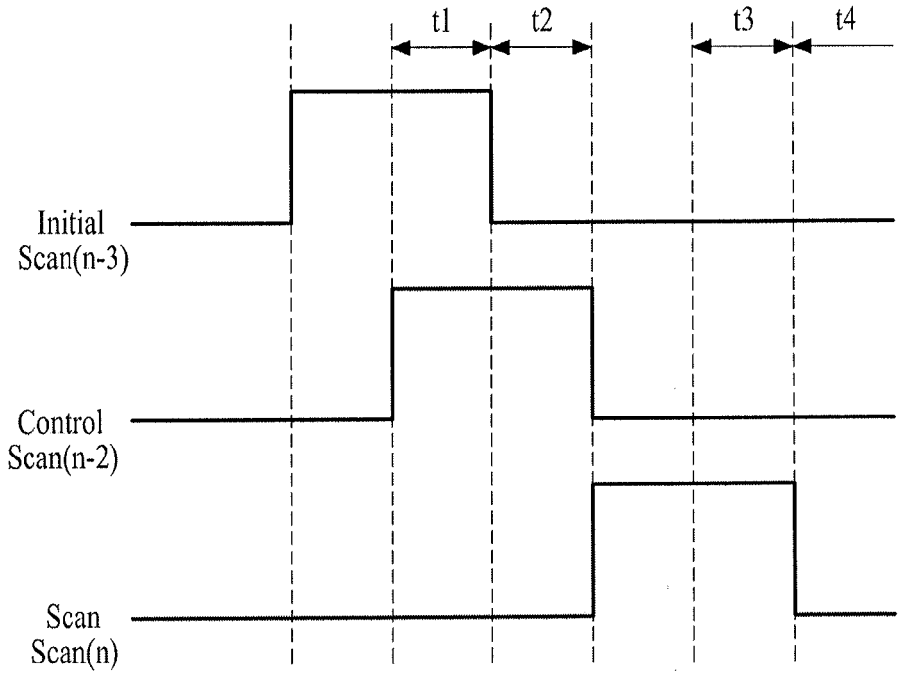
FIG. 5 is a timing chart according to a second embodiment of each of the control signals supplied to the equivalent circuit of FIG. 2.

FIG. 5 is a timing chart according to a second embodiment of each of the control signals supplied to the equivalent circuit of FIG. 2.

In the OLED display device according to embodiments of the present disclosure, as illustrated in FIG. 5, the initialization signal "Initial," the control signal "Control," and the scan signal "Scan" are scan signals that are outputted from the same scan driving driver, and may respectively be an n-3rd scan signal "Scan(n-3)," an n-2nd scan signal "Scan(n-2)," and an nth scan signal "Scan(n)." Also, a time for which the scan signals are overlapped may be adjusted by adjusting the pulse width of each of the scan signals.

In other words, the control signals may be scan signals that are outputted from one scan driving driver to respective scan lines. Accordingly, the n-3rd scan signal "Scan(n-3)" may be a scan signal corresponding to the first stage of three stages prior to that of the nth scan signal "Scan(n)," and the n-2nd scan signal "Scan(n-2)" may be a scan signal corresponding to the first stage of two stages prior to that of the nth scan signal "Scan(n)."

Referring to FIG. 5, during the initialization time period t1, the n-3rd scan signal "Scan(n-3)" and the n-2nd scan signal "Scan(n-2)" that have a high level may be applied to a sub-pixel, and the nth scan signal "Scan(n)" having a low level may be applied to the sub-pixel.

During the threshold voltage sensing time period t2, the n-2nd scan signal "Scan(n-2)" having a high level is applied to the sub-pixel, and the n-3rd scan signal "Scan(n-3)" and the nth scan signal "Scan(n)" that have a low level may be applied to the sub-pixel.

During the data application time period t3, the nth scan signal "Scan(n)" having a high level may be applied to the sub-pixel, and the n-3rd scan signal "Scan(n-3)" and the n-2nd scan signal "Scan(n-2)" that have a low level may be applied to the sub-pixel.

During the emission time period t4, the n-3rd scan signal "Scan(n-3)," the n-2nd scan signal "Scan(n-2)," and the nth scan signal "Scan(n)" that have a low level may be applied to the sub-pixel.

In the above description, the current "$I_{OLED}$" flowing in the OLED has been described as not being affected by the low-level power supply voltage "VSS" or the threshold voltage "Vth" of the driving transistor Tdr. This will be described with reference to FIGS. 6 and 7.

Figure 6:
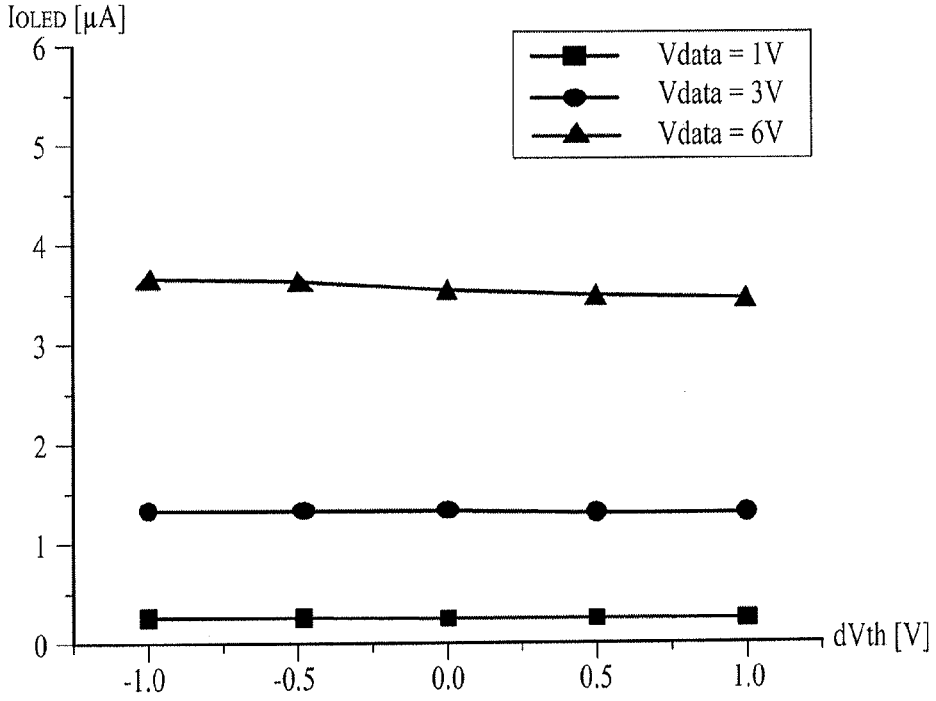
FIGS. 6 and 7 are diagrams illustrating simulation results for describing a current being changed due to the deviation of a threshold voltage and the deviation of a low-level power supply voltage in the OLED display device according to embodiments of the present disclosure.
Figure 7:
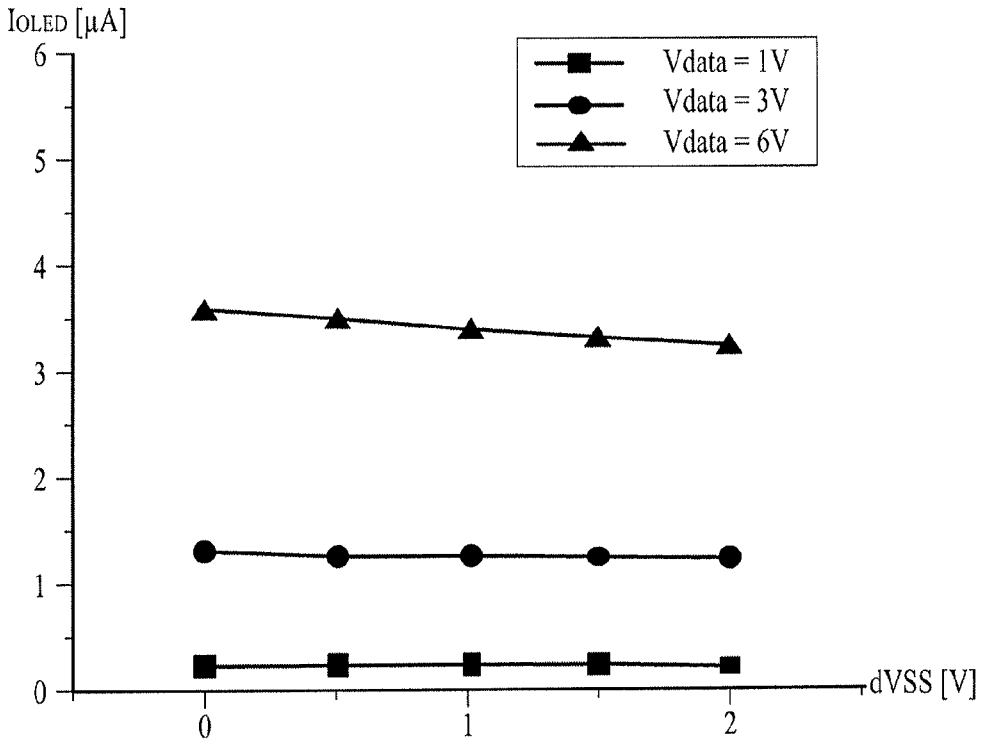

FIGS. 6 and 7 are diagrams showing simulation results for describing a current being changed due to the deviation of a threshold voltage and the deviation of a low-level power supply voltage in the OLED display device according to embodiments of the present disclosure.

As illustrated in FIG. 6, the level of the current "$I_{OLED}$" flowing in the OLED is proportional to the data voltage "Vdata." But the current "$I_{OLED}$" is maintained at a constant level irrespective of the deviation "dVth" of the threshold voltage "Vth" in the same data voltage "Vdata" when the data voltage "Vdata" is at 1V or 3V in some embodiments. The current "$I_{OLED}$" only varies slightly by the deviation "dVth" when the data voltage "Vdata" is at 6V in another embodiment.

Moreover, as illustrated in FIG. 7, the level of the current "$I_{OLED}$" flowing in the OLED is proportional to the data voltage "Vdata" similarly to FIG. 6. But the current "$I_{OLED}$" is maintained at a constant level irrespective of the deviation "dVSS" of the low-level power supply voltage "VSS" in the same data voltage "Vdata" when the data voltage "Vdata" is at 1V or 3V in some embodiments. The current "$I_{OLED}$" only varies slightly by the deviation "dVSS" when the data voltage "Vdata" is at 6V in another embodiment.

As described above, by using the source follower structure, the OLED display device according to embodiments of the present disclosure compensates for the deviation of the threshold voltage irrespective of the polarity of the threshold voltage of the driving transistor Tdr, and thus maintains a constant current flowing in an OLED, preventing the degradation of image quality.

Furthermore, by compensating for the deviation of the low-level power supply voltage due to IR drop that is caused by a low-level voltage, the OLED display device according to embodiments of the present disclosure maintains a constant current flowing in an OLED, thus preventing the degradation of image quality.

Moreover, by removing an emission control transistor, the OLED display device according to the embodiment of the present disclosure can prevent image quality from being degraded due to the deterioration of the emission control transistor.

According to the embodiments of the present disclosure, even when the threshold voltage of a driving transistor (Tdr) has a negative polarity, the threshold voltage is sensed, and thus, the OLED display device compensates for the deviation of the threshold voltage irrespective of the polarity of the threshold voltage and compensates for the deviation of a low-level power supply voltage due to IR drop. Accordingly, the OLED display device maintains a constant current flowing in an OLED, thus preventing the degradation of image quality.

Moreover, according to the embodiment of the present disclosure, by not using an emission control transistor, the OLED display device can prevent image quality from being degraded due to the deterioration of the emission control transistor.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The invention claimed is:

1. An organic light emitting diode (OLED) display device, comprising:

a first transistor directly connected to a data line and a first node, configured to transfer a data voltage from the data line to the first node;

a second transistor directly connected to the first node and a second node, wherein the first node is directly connected to the first transistor;

a third transistor directly connected to a reference voltage terminal and a third node, configured to transfer a reference voltage from the reference voltage terminal to the third node, wherein the third node is directly connected to a gate of a driving transistor;

a fourth transistor directly connected to an initialization voltage terminal and the second node, configured to transfer an initialization voltage from the initialization voltage terminal to the second node;

a fifth transistor directly connected to the reference voltage terminal and the second node;

the driving transistor having a source connected to the second node, the gate connected to the third node, and a drain connected to a high-level power supply voltage terminal; and an OLED connected to a low-level power supply voltage terminal and the second node.

2. The OLED display device of claim 1, further comprising: a first capacitor connected between the first and third nodes.

3. The OLED display device of claim 1, further comprising: a second capacitor connected between the first and second nodes, and holding the data voltage during one frame.

4. The OLED display device of claim 1, wherein the first transistor is controlled by a scan signal from a corresponding scan line.

5. The OLED display device of claim 1, wherein the second and third transistors are controlled by a control signal from a corresponding control line.

6. The OLED display device of claim 1, wherein the first and fifth transistors are controlled by a scan signal from a corresponding scan line.

7. The OLED display device of claim 1, wherein the fourth transistor is controlled by an initialization signal.

8. The OLED display device of claim 1, wherein the driving transistor is configured to adjust the amount of a current flowing in the OLED according to a voltage applied to the third node corresponding to the gate of the driving transistor.

9. The OLED display device of claim 1, wherein a current flowing in the OLED is determined by an arbitrary voltage "Va" proportional to the data voltage.

10. A method for driving an organic light emitting diode (OLED) display device, comprising:

providing an OLED display comprising a first transistor connected to a data line and a first node and configured to transfer a data voltage from the data line to the first node; a second transistor connected to the first node and a second node; a third transistor connected to a reference voltage terminal and a third node and configured to transfer a reference voltage from the reference voltage terminal to the third node; a fourth transistor connected to an initialization voltage terminal and the second node; a fifth transistor connected to the reference voltage terminal and the second node; a driving transistor having a source connected to the second node, a gate connected to the third node, and a drain connected to a high-level power supply voltage terminal; and an OLED connected to a low-level power supply voltage terminal and the second node;

applying an initialization voltage to the first node and the second node and applying a reference voltage to the third node while the second to fourth transistors are turned on;

applying a threshold voltage to the driving transistor while the second and third transistors are turned on;

applying a data voltage to the first node, while the first and fifth transistors are turned on; and emitting, by the OLED, light while the first to fifth transistors are turned off.

11. The method of claim 10, wherein applying an initialization voltage to the first node and the second node comprises:

applying the initialization voltage to the first node connected to a first capacitor and a second capacitor, wherein the first capacitor is connected between the first and third nodes and the second capacitor is connected between the first and second nodes.

12. The method of claim 11, wherein applying the threshold voltage to the driving transistor comprises:

applying the threshold voltage to the driving transistor that corresponds to a voltage difference between both ends of the first capacitor.

13. The method of claim 10, wherein applying the data voltage to the first node comprises:

applying, by the first transistor, the data voltage to the first node based on a scan signal from a corresponding scan line.

14. The method of claim 10, further comprising:

controlling the second and third transistors by a control signal from a corresponding control line.

15. The method of claim 10, further comprising:

controlling the first and fifth transistors by a scan signal from a corresponding scan line.

16. The method of claim 10, further comprising:

controlling the fourth transistor by an initialization signal.

17. The method of claim 10, further comprising:

adjusting, by the driving transistor, an amount of a current flowing in the OLED according to the reference voltage applied to the third node.

18. The method of claim 17, wherein the amount of the current flowing in the OLED is determined by an arbitrary voltage "Va" proportional to the data voltage.

19. The method of claim 10, further comprising:

applying the reference voltage to the fifth transistor.

20. An organic light emitting diode (OLED) display device, comprising:

a first transistor directly connected to a data line and a first node, configured to transfer a data voltage from the data line to the first node;

a second transistor directly connected to the first node and a second node, wherein the first node is directly connected to the first transistor;

a third transistor directly connected to a reference voltage terminal and a third node, configured to transfer a reference voltage from the reference voltage terminal to the third node, wherein the third node is directly connected to a gate of a driving transistor;

a fourth transistor directly connected to an initialization voltage terminal and the second node, configured to transfer an initialization voltage from the initialization voltage terminal to the second node;

a fifth transistor directly connected to the reference voltage terminal and the second node;

the driving transistor having a source connected to the second node, the gate connected to the third node, and a drain connected to a high-level power supply voltage terminal; and an OLED connected to a low-level power supply voltage terminal and the second node, wherein a current flowing in the OLED is determined by a voltage proportional to the data voltage.

* * * * *